United States Patent [19]

Goncalves

[11] Patent Number: 4,809,914

[45] Date of Patent: Mar. 7, 1989

[54] FLEXIBLE BOTTLE MAKING IT POSSIBLE TO EFFECT SPRAYING OR DROP BY DROP DISPENSING OF A LIQUID CONTAINED THEREIN

[75] Inventor: Antonin Goncalves, Groslay, France

[73] Assignee: L'Oreal, Paris, France

[21] Appl. No.: 122,513

[22] PCT Filed: Aug. 22, 1985

[86] PCT No.: PCT/FR85/00226

§ 371 Date: Mar. 24, 1986

§ 102(e) Date: Mar. 24, 1986

[87] PCT Pub. No.: WO86/01438

PCT Pub. Date: Mar. 13, 1986

Related U.S. Application Data

[63] Continuation of Ser. No. 859,628, Mar. 24, 1986, abandoned.

[30] Foreign Application Priority Data

Aug. 28, 1984 [FR] France ..... 84 13289

[51] Int. Cl.[4] ..... B65D 1/32

[52] U.S. Cl. ..... 239/327; 222/211

[58] Field of Search ..... 222/331, 330, 200, 211, 222/215, 420, 421, 478, 561, 212; 239/436, 437, 443, 444, 327

[56] References Cited

U.S. PATENT DOCUMENTS

| | | | |
|---|---|---|---|
| 2,115,959 | 5/1938 | Lewis | 239/327 |
| 2,141,572 | 12/1938 | Tucker | 222/561 X |
| 2,277,936 | 3/1942 | Rosenblatt | 222/420 |
| 2,684,789 | 7/1954 | Marchant | 222/215 X |
| 2,764,453 | 9/1956 | Robb et al. | 239/327 |
| 2,823,836 | 2/1958 | Bach | 222/421 X |
| 2,927,717 | 3/1960 | McDermott | 222/561 X |
| 3,170,633 | 2/1965 | Castelli | 239/327 |
| 3,185,352 | 5/1965 | Ghisolfi | 239/327 X |
| 3,447,724 | 6/1969 | Fiddyment | 222/561 X |
| 3,731,855 | 5/1973 | Vos | 222/561 X |
| 4,157,789 | 6/1979 | Laawe | 222/211 X |
| 4,162,749 | 7/1979 | Bennett | 222/212 X |
| 4,541,551 | 9/1985 | Vierkotter et al. | 222/561 X |
| 4,600,130 | 7/1986 | Zibit | 222/212 X |

FOREIGN PATENT DOCUMENTS

| | | |
|---|---|---|
| A0084296 | 7/1983 | European Pat. Off. . |
| A1036025 | 7/1966 | United Kingdom . |

*Primary Examiner*—Andres Kashnikow
*Assistant Examiner*—Kevin P. Weldon
*Attorney, Agent, or Firm*—Cushman, Darby & Cushman

[57] ABSTRACT

The bottle comprises in its upper portion a spraying orifice (6) and a drop by drop dispensing orifice (7) with a larger cross section, provision being made for shutters for selecting one of the orifices. The bottle has a flattened shape and has two flat narrow facing sides (2, 3); the spraying orifice (6) and the dispensing orifice (7) are provided respectively towards the top of each narrow side. The selection devices comprise, for each orifice, a push shutter (18, 19) movable in translation along the direction of the large dimension of the corresponding side between one position wherein the associated orifice is closed and another position wherein the orifice is open.

7 Claims, 2 Drawing Sheets

FIG.3.
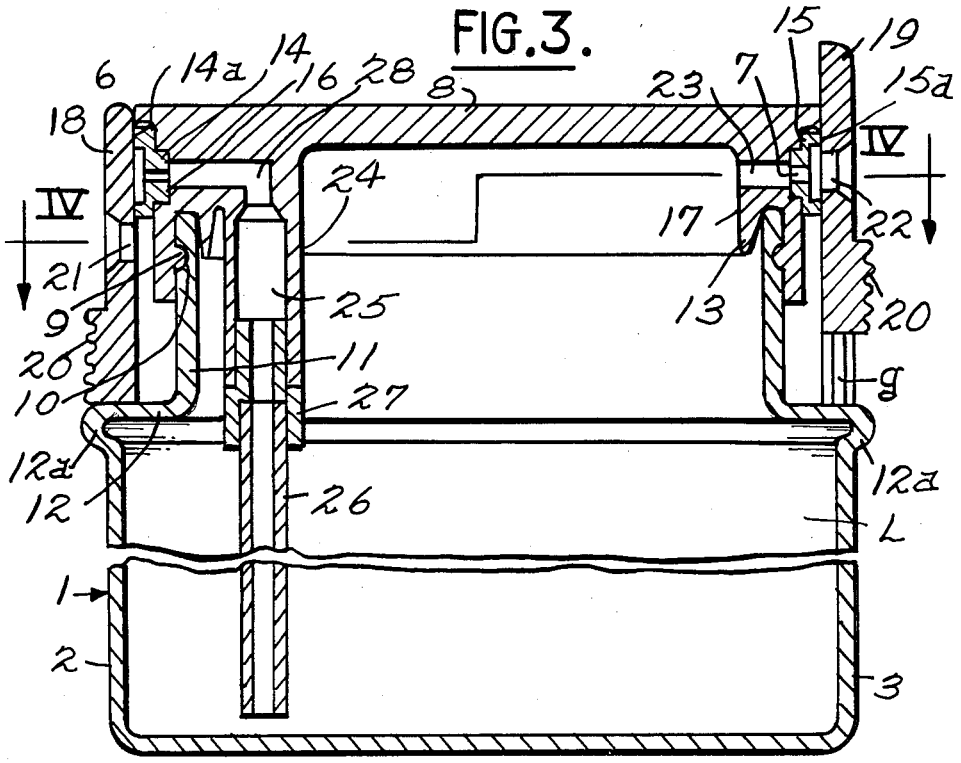
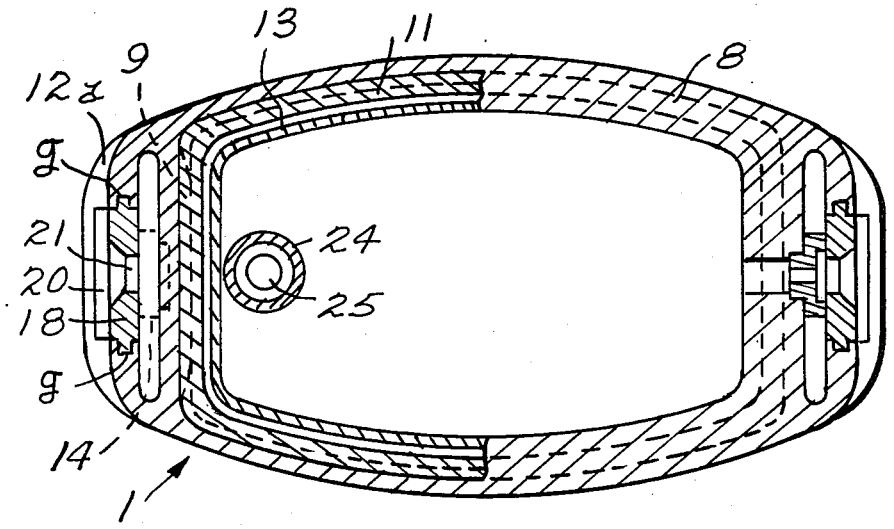
FIG.4.

FLEXIBLE BOTTLE MAKING IT POSSIBLE TO EFFECT SPRAYING OR DROP BY DROP DISPENSING OF A LIQUID CONTAINED THEREIN

This is a continuation of application Ser. No. 849,628 filed Mar. 24, 1986 which was abandoned.

The invention relates to a flexible bottle making it possible to effect either spraying or drop by drop dispensing of a liquid contained therein, a bottle of the kind containing in its upper portion a spraying orifice associated with means for the take up of the liquid into the bottle, and a drop by drop dispensing orifice with a larger cross section than that of the spraying orifice, provision, moreover, being made for the selection of one of the orifices.

Such a bottle makes it possible to choose, depending on the use envisaged for the product of this bottle, between the spraying obtained by the forces of successive compression and relaxation of the wall of the bottle, and the drop by drop dispensing.

This is an appreciable advantage of this kind of bottle.

However, the handling of such a bottle, particularly with a view to producing the spraying, requires improvement.

The object of the invention is, above all, to provide a flexible bottle of the kind defined above which should be more convenient to handle and to use than the kind of bottles known to data whilst making it possible to ensure either the spraying or drop by drop dispensing in equally good conditions.

A flexible bottle of the kind defined above is characterised in that it has a flattened shape and has two narrow flat facing sides and that provision is made respectively for the spraying orifice and dispensing orifice towards the top of each narrow side and that the selection means comprise for each orifice, a push shutter which is displaceable in translation along the direction of the large dimension of the corresponding side, between one position wherein the orifice associated with the push plate is closed and another position wherein the said orifice is open.

Such a bottle is easy to manipulate and allows the direction of the jet which will emerge to be properly set before any pressure is exerted on the bottle walls with a view to spraying.

Preferably, the bottle is provided with a cap fixed by catch engagement in particular, this cap being provided with a sealing skirt capable of entering into the upper portion of the bottle and to bear in a leakproof manner against the internal surface of this bottle; the above mentioned orifices and push shutters are provided on the cap.

Each orifice is advantageously provided in a nozzle which comprises a flange projecting towards the outside capable of bearing in a leakproof manner against the opposite side of the push shutter, this push shutter comprising an opening with a larger diameter than that of the corresponding orifice, this opening being capable of coming to be opposite the orifice when the push plate is in the open position.

The bottle generally comprises, in the upper portion, a neck with a smaller cross section whereon the cap comes to be located, the cross section of the cap having substantially the same dimensions as those of the portion of the bottle situated below the neck.

The push shutters are guided in grooves provided on the cap. These push plates have a flat external surface essentially situated in the plane of the associated side of the bottle, the said external surface comprising, however, projecting ribs with a view to facilitating the action on the push plate.

The cap generally comprises a housing associated with each orifice intended to accommodate the corresponding nozzle. Moreover, a return forming an appendage of the cap towards the bottom of the bottle is associated with the spraying orifice, this return being intended to carry a plunger tube.

Generally, the two narrow sides of the bottle are joined to each other by two much wider sides which are slightly convex towards the outside. The compressive forces applied by the user to produce the spraying are exerted on these wider sides.

Apart from the arrangements set out above, the invention consists of certain other arrangements which will be discussed in greater detail below in relation to a particular mode of embodiment described with reference to the attached drawings but which is in no way restrictive.

FIG. 1 of these drawings is a view in perspective of a bottle in accordance with the invention used so as to produce spraying.

FIG. 3 is a cross section on an enlarged scale along the median plane of the bottle.

FIG. 4, finally, is a cross section along IV—IV of FIG. 3.

Figure 1:
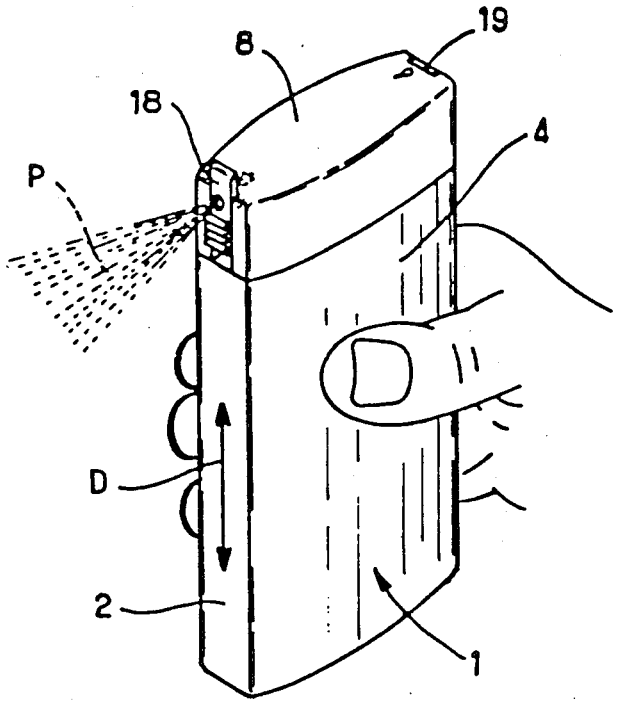
Figure 2:
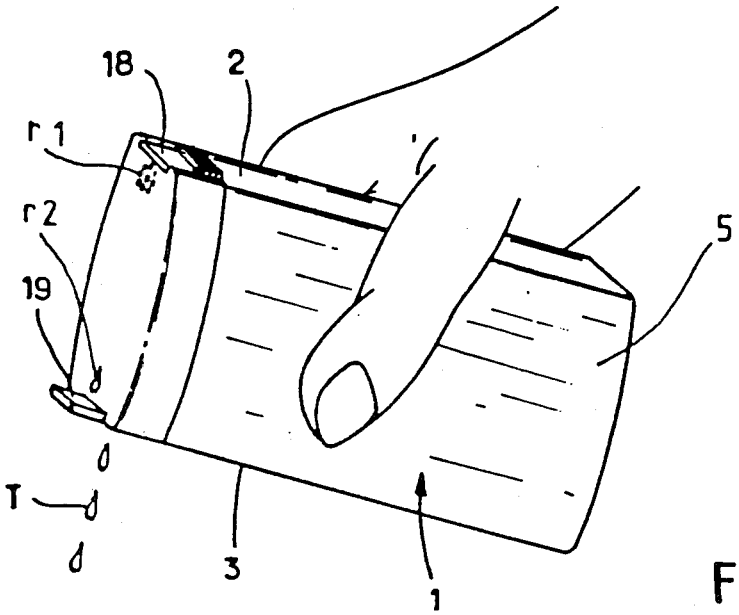
FIG. 2 is a view in perspective of the same bottle, used for drop by drop dispensing.

Referring to the drawings, one can see a flexible bottle 1 made in particular of polyethylene or an equivalent material making it possible to effect either spraying as represented in FIG. 1, or a drop by drop dispensing as represented in FIG. 2 of a liquid which is contained therein.

The flexible bottle 1 has a flattened shape and has two flat narrow facing sides 2, 3. Each side 2, 3 has a rectangular shape; the ratio of the length to width of this side is preferably greater than 4. The sides 2 and 3 are joined by lateral sides 4 and 5 which are wider (in particular at least twice as wide as the sides 2 and 3), constituting cylindrical portions whose generatrices are parallel to the large dimension of the sides 2 and 3; these sides 4 and 5 are convex towards the outside. The transverse cross section of the bottle 1 has a substantially oval shape as may be seen in FIG. 4. Provision is made for a spraying orifice (FIG. 3) and a drop by drop dispensing orifice 7 towards the top of each narrow side 2,3. The orifice 7 has a larger cross section than orifice 6.

The bottle 1 is advantageously provided with a cap 8 made preferably of a more rigid material than that of the bottle 1. For instance, the cap 8 can be made of polypropylene. This cap 8, as may be seen in FIG. 3, is fixed on the body of the bottle by catch engagement of a peripheral internal bead 9 in a peripheral groove 10 provided on the upper portion of the bottle. This upper portion is arranged in the form of a collar 11 or neck whose transverse cross section is smaller than the rest of the bottle.

This neck is joined to the bottle as a whole via a transverse flange 12 which is itself joined to the body of the bottle via convex portions 12*a*. The cap is provided with a sealing skirt 13 capable of entering into the neck 11 with a light grip and to bear in a leakproof manner on the internal surface of this neck. The sides of the cap are substantially in the extension of the sides of the bottle 1 and may be considered as part of the bottle. The transverse cross section of the cap thus has substantially the same dimensions as those of the portion of the bottle situated below the neck 1.

Provision is advantageously made for the orifices 6 and 7 in a nozzle 14, 15 mounted in a recess 16, 17 of the cap 8.

Each nozzle comprises a flange 14*a*, 15*a* projecting towards the outside capable of bearing in a leakproof manner on a flat facing surface of a push shutter 18, 19. Each push plate can slide along a direction D parallel to the large dimension of sides 2 and 3 (FIGS. 1 and 2)being guided in grooves such as g (FIGS. 3 and 4) provided for in the cap 8, on either side of each push plate. The push plates 18,19 have a flat external surface situated essentially in the plane of the associated external side 2, 3 of the bottle. However, provision is made for projecting ribs 20 at the base of each push shutter 18, 19 on the side of flange 12 to facilitate the action on the corresponding push plate.

Each push plate 18, 19 comprises respectively one opening 21, 22 with a diameter largely exceeding that of the corresponding orifices 6, 7. Provision is made for stop means (not shown) on the grooves g to stop the push plate 24 in its travel which moves it away from flange 12 into such a position that the opening of this push plate should be substantially coaxial with the associated orifice 6 or 7. This opening position is represented in FIG. 3 for the push plate.

On the other hand, when the push plate bears on the flange 12, its upper portion is flush with the upper portion of the cap 8 while the associated orifice 6 and 7 is closed. The push plate 18 has been represented in this closed position in FIG. 3.

The push plates 18, 19 constitute means for selecting one of the orifices 6, 7.

A transverse duct 23 passes through the wall of the cap to join the orifice 7 with the internal space.

On the side of orifice 6, provision is made for a return 24 forming an appendage orthogonal to the top—of cap 8. This return 24 which is tubular in shape and comprising an internal housing 25, is intended to carry a plunger tube 26; an end fitting 27 ensures the mechanical connection between the appendage 24 and the tube 26. The end fitting 27 comprises a portion with a smaller diameter engaged in the housing 25 and a portion with a larger diameter wherein the tube 26 is fitted. The housing 25 is caused to communicate via a bent ducting 28 with the orifice 6. Tube 26 extends as far as the vicinity of the bottom of bottle 1. The opening 6 therefore communicates with the internal space of the bottle through the intermediary of the ducting 28, of the housing 25, of the passage passing through the end fitting 27, and of tube 26.

For the assembly of such a bottle, the cap 8 is—supplied fitted with the nozzles 14 and 15, with the plunger tube 26 and the two obturating push plates 18, 19.

The assembly is effected on the filling line; after the body of bottle 1 properly so called is filled with liquid L, the cap 8 is fitted by catch engagement on the neck 11 of the bottle.

The utilisation of this bottle follows directly from the above explanations.

When one wishes to dispense the liquid L by spraying, the orifice 7 is closed by pushing the obturator 19 against the flange 12 whilst the spraying orifice 6 is opened by displacing the obturator 18 to move it away from flange 12.

Bottle 1 is then gripped, as shown in FIG. 1, between the thumb and the other fingers of the hand and the sides 4 and 5 are alternately squeezed and then released—to produce the spraying P.

If a drop by drop dispensing of the product is required, the obturator 18 is closed and the obturator 19 is opened which corresponds to the situation of FIG. 3. The bottle 1 is then gripped between the thumb and the other fingers of the hand and this bottle is slightly tilted in such a way that the orifice 7 is directed downwards. The drops T run out via the opening 7. The flow of the drops may be accelerated by exerting pressure on bottle 1.

It should be noted that the narrow sides 2, 3 are relatively resistant with regard to the forces exerted during the squeezing action because of their small width. Moreover, since the cap 8 is made of a generally more rigid material than that of the bottle, the sides of this cap extending sides 2 and 3 are also relatively resistant.

It follows therefrom that the product will be dispensed, in particular during the spraying action, along a relatively well determined direction, that is to say, a direction orthogonal to the side 2, because this side and the corresponding extension of the cap will not be subjected to substantial deformation during the squeezing exertions.

Moreover, the flattened, oval shape of this bottle also makes it possible to determine, intuitively, the direction of the spraying jet which corresponds to the median direction of the length of the cross section. This shape facilitates the gripping of the bottle.

It is clear that the expression "flexible bottle" is not restrictive and designates any bottle capable of being deformed by manual pressure to produce spraying.

Provision is advantageously made for marks r1, r2 (FIG. 2) on the upper side of the cap to permit identification of the side intended for spraying and that intended for drop by drop dispensing.

I claim:

1. A flexible bottle for effecting either a spraying operation or drop by drop dispensing of a liquid contained therein, said bottle comprising an upper portion having a spraying orifice associated with means for the take up of the liquid in the bottle, and drop by drop dispensing orifice having a larger cross-section than the spraying orifice, means for selecting one of the orifices, said bottle having a flattened shape and having two flat narrow facing sides, one of said sides having said drop by drop dispensing orifice and the other of said sides having said spraying orifice, each said orifice having associated therewith a push shutter, each push shutter being movable in translation along a direction parallel to the large dimension of the corresponding facing side between one position wherein the associated orifice is closed and another position wherein said respective orifice is open, said upper portion of said bottle comprising a cap having said facing sides and said selection means, said bottle having a neck receiving said cap, said bottle having a selected width and said neck being of a reduced width relative to said width of said bottle, said neck having two flat narrow facing sides extending substantially parallel to said flat narrow facing sides of said bottle and said cap having two flat narrow facing sides on opposite ends thereof extending in abutting relationship with said two flat narrow facing sides of said neck but being recessed from the plane in which said two flat narrow facing sides of said bottle extend, said shutters each lying substantially in said plane of said respective two flat narrow facing sides of said bottle, said cap being made of a material that is relatively more rigid than the material of said bottle, said bottle having a transverse wall surrounding said neck with said juncture of said transverse wall and the bottle defining a convex portion surrounding said transverse wall, said transverse wall serving as a stop for each of said push shutters when each said shutter is moved from said another position to said one position, said bottle having two side walls of larger dimension than said two narrow flat facing sides and extending therebetween, said two flat narrow facing sides being located at a position to minimize transmission of deformations thereto when said side walls of larger dimension are compressed.

2. A bottle according to claim 1, characterised in that each orifice (6, 7) is provided in a nozzle (14, 15) which comprises a flange (14*a*, 15*a*) projecting towards the outside, capable of bearing in a leakproof manner against the side opposite of the push shutter, this push shutter comprising an opening (21, 22) with a larger diameter than that of the corresponding orifice (6, 7), this opening being capable of coming to be opposite the orifice when the push shutter is in the open position.

3. A bottle according to the claim 1, characterised in that the cap comprises a recess (16, 17) associated with each orifice (6, 7) intended to accommodate the corresponding nozzle.

4. A bottle according to claim 3, characterised in that the push shutters (18, 19) are guided in the grooves (g) provided in the cap.

5. A bottle according to claim 1 characterised in that the push plates (18, 19) have a flat external surface essentially situated in the plane of the associated side (2, 3) of the bottle, the said external surface of the push shutters comprising projecting rib sections (20) for facilitating the action on the push shutters 6. A bottle according to claim 1, characterised in that the cap (8) comprises a return (24) forming an appendage towards the bottom of the bottle, associated with the spraying orifice (6), this return being intended to carry a plunger tube (26).

7. A bottle according to claim 1, characterised in that the sidewalls of larger dimension are slightly convex towards the outside.

* * * * *